US010219067B2

(12) United States Patent
Horbach

(10) Patent No.: US 10,219,067 B2
(45) Date of Patent: Feb. 26, 2019

(54) AUTO-CALIBRATING NOISE CANCELING HEADPHONE

(71) Applicant: Harman International Industries, Inc., Stamford, CT (US)

(72) Inventor: Ulrich Horbach, Canyon Country, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/505,857

(22) PCT Filed: Aug. 29, 2014

(86) PCT No.: PCT/US2014/053509

§ 371 (c)(1),
(2) Date: Feb. 22, 2017

(87) PCT Pub. No.: WO2016/032523

PCT Pub. Date: Mar. 3, 2016

(65) Prior Publication Data

US 2017/0245045 A1 Aug. 24, 2017

(51) Int. Cl.
*H04R 29/00* (2006.01)
*G10K 11/175* (2006.01)
(Continued)

(52) U.S. Cl.
CPC ..... *H04R 1/1083* (2013.01); *G10K 11/175* (2013.01); *H04R 1/1041* (2013.01);
(Continued)

(58) Field of Classification Search
CPC ..... H04R 3/005; H04R 1/1083; H04R 3/04; H04R 2410/05; H04R 2460/01;
(Continued)

(56) References Cited

U.S. PATENT DOCUMENTS 3,599,488 A * 8/1971 Mather ..... B64D 45/00 244/182
4,291,781 A * 9/1981 Niguchi ..... D06M 17/06 162/104
(Continued)

FOREIGN PATENT DOCUMENTS

CN 2924986 Y 7/2007
CN 102769816 A 11/2012
(Continued)

OTHER PUBLICATIONS

PCT International Search Report dated May 28, 2015 for PCT/US2014/053509.
(Continued)

*Primary Examiner* — Norman Yu
(74) *Attorney, Agent, or Firm* — Brooks Kushman P.C.

(57) ABSTRACT

A sound system is provided with a headphone that includes a transducer and at least one microphone. The sound system also includes an equalization filter and a loop filter circuit. The equalization filter is adapted to equalize an audio input signal based on at least one predetermined coefficient. The loop filter circuit includes a leaky integrator circuit that is adapted to generate a filtered audio signal based on the equalized audio input signal and a feedback signal indicative of sound received by the at least one microphone, and to provide the filtered audio signal to the transducer.

10 Claims, 9 Drawing Sheets

(51) Int. Cl.

| | |
|---|---|
| ***H04R 1/10*** | (2006.01) |
| ***H04R 3/04*** | (2006.01) |
| ***H04R 3/00*** | (2006.01) |
| ***H04R 1/40*** | (2006.01) |

(52) U.S. Cl.
CPC ..... *H04R 1/406* (2013.01); *H04R 3/005* (2013.01); *H04R 3/04* (2013.01); *H04R 29/001* (2013.01); *H04R 2307/021* (2013.01); *H04R 2410/05* (2013.01); *H04R 2460/01* (2013.01)

(58) Field of Classification Search
CPC .. H04R 29/004; H04R 1/406; H04R 2420/07; H04R 2410/07; H04R 2410/01; H04R 29/00; H04R 2430/21; H04R 25/405; H04R 5/033; H04R 25/65; H04R 1/08; H04R 29/005; H04R 1/1008; H04R 1/1016; H04R 5/00; G10L 2021/02087; G10L 2021/02166; G10L 21/0216; G10L 2021/02165; G10L 2021/02082; G10L 21/02; G10L 19/26; G10L 21/0208; G10K 2210/1081; G10K 11/002; G10K 11/178; G10K 2210/3028; G10K 11/175; G10K 2210/108; H04S 7/304; H04S 1/005; H04S 7/301; H04S 7/306
USPC ..... 381/92, 71.6, 56, 71.1, 150, 312, 57, 74, 381/94.1, 122, 26, 309, 317, 58, 7, 1.11, 381/71.8, 94.2; 704/226, 233; 455/570, 455/556.1
See application file for complete search history.

(56) References Cited

U.S. PATENT DOCUMENTS

| | | | | |
|---|---|---|---|---|
| 4,741,035 | A | 4/1988 | Genuit | |
| 5,182,774 | A | 1/1993 | Bourk | |
| 5,402,497 | A * | 3/1995 | Nishimoto | G10K 11/178 381/95 |
| 5,481,615 | A * | 1/1996 | Eatwell | G10K 11/1784 381/103 |
| 5,499,302 | A | 3/1996 | Masaaki et al. | |
| 5,928,160 | A | 7/1999 | Clark et al. | |
| 5,937,070 | A * | 8/1999 | Todter | G10K 11/1782 381/71.12 |
| 5,987,145 | A | 11/1999 | Lawton | |
| 6,597,792 | B1 * | 7/2003 | Sapiejewski | H04R 1/1083 381/371 |
| 7,103,188 | B1 | 9/2006 | Jones | |
| 8,447,045 | B1 * | 5/2013 | Laroche | A61F 11/14 381/71.1 |
| 8,879,743 | B1 | 11/2014 | Mitra | |
| 2005/0130697 | A1 * | 6/2005 | Dyer | H01R 13/7036 455/550.1 |
| 2005/0249355 | A1 | 11/2005 | Chen | |
| 2006/0093159 | A1 | 5/2006 | Koh et al. | |
| 2006/0147057 | A1 | 7/2006 | Aggarwal et al. | |
| 2006/0262938 | A1 | 11/2006 | Gauger et al. | |
| 2007/0195963 | A1 | 8/2007 | Ko et al. | |
| 2007/0253577 | A1 * | 11/2007 | Yen | H03G 5/005 381/103 |
| 2008/0165981 | A1 | 7/2008 | Wurtz | |
| 2009/0220107 | A1 * | 9/2009 | Every | G10L 21/0208 381/94.7 |
| 2010/0195842 | A1 * | 8/2010 | Sibbald | G10K 11/1788 381/71.6 |
| 2010/0296668 | A1 * | 11/2010 | Lee | G10K 11/1784 381/94.7 |
| 2010/0305725 | A1 | 12/2010 | Brannmark et al. | |
| 2011/0158419 | A1 * | 6/2011 | Theverapperuma | G10K 11/178 381/71.1 |
| 2011/0206214 | A1 | 8/2011 | Christoph et al. | |
| 2011/0293103 | A1 * | 12/2011 | Park | G10K 11/1782 381/57 |
| 2012/0087510 | A1 * | 4/2012 | Sampimon | H04R 1/1083 381/74 |
| 2012/0278070 | A1 | 11/2012 | Herve et al. | |
| 2013/0236023 | A1 | 9/2013 | Horbach | |
| 2013/0243200 | A1 | 9/2013 | Horbach | |
| 2014/0126734 | A1 * | 5/2014 | Gauger, Jr. | H04R 3/002 381/71.6 |
| 2014/0146973 | A1 | 5/2014 | Liu et al. | |
| 2014/0167991 | A1 * | 6/2014 | Oshita | H03M 3/458 341/143 |
| 2014/0341388 | A1 | 11/2014 | Goldstein et al. | |

FOREIGN PATENT DOCUMENTS

| | | | |
|---|---|---|---|
| JP | 04107993 | | 9/1992 |
| JP | 06070391 | A | 3/1994 |
| JP | 08079873 | A | 3/1996 |
| JP | 09230876 | | 9/1997 |
| JP | 2004163875 | | 6/2004 |
| JP | 2009033309 | A | 2/2009 |
| JP | 201215833 | A | 1/2012 |
| JP | 2012044276 | | 3/2012 |

OTHER PUBLICATIONS

PCT International Prelimnary Report on Patentability and Written Opinion dated Feb. 28, 2017 for PCT/US2014/053509.
Extended European Search Report dated Mar. 8, 2018 for EP14900626.4.

* cited by examiner

AUTO-CALIBRATING NOISE CANCELING HEADPHONE

TECHNICAL FIELD

One or more embodiments generally relate to active noise cancellation headphones and auto-calibrating noise cancelling headphones.

BACKGROUND

The continuing miniaturization of electronic devices has led to a variety of portable audio devices that deliver audio to a listener via headphones. The miniaturization of electronics has also led to smaller and smaller headphones that produce high quality sound. Some headphones now include noise cancellation systems that include microphones for obtaining external sound data and a controller for reducing or cancelling the external sounds that are generated in the user's environment.

SUMMARY

In one embodiment a headphone is provided with a housing including an aperture formed therein and a transducer that is disposed in the aperture and supported by the housing. The headphone also includes an array of microphones that are coupled to the housing and disposed over the transducer to receive sound radiated by the transducer and noise.

In another embodiment a sound system is provided with a headphone that includes a transducer and at least one microphone. The sound system also includes an equalization filter and a loop filter circuit. The equalization filter is adapted to equalize an audio input signal based on at least one predetermined coefficient. The loop filter circuit includes a leaky integrator circuit that is adapted to generate a filtered audio signal based on the equalized audio input signal and a feedback signal indicative of sound received by the at least one microphone, and to provide the filtered audio signal to the transducer.

In yet another embodiment a computer-program product embodied in a non-transitory computer readable medium that is programed for automatically calibrating an active noise cancellation control system within a headphone is provided. The computer-program product includes instructions for generating a first audio input signal that is indicative of a test signal, filtering the first audio input signal using an equalization filter and a loop filter and providing the first filtered audio signal to a transducer of the headphone, wherein the transducer is adapted to radiate a test sound in response to the first audio signal. The computer-program product further includes instructions for receiving a first feedback signal indicative of a spatial average of the test sound received by at least one microphone of the headphone and updating a coefficient of the equalization filter based on the first feedback signal.

As such the sound system provides advantages over existing ANC sound systems by generating a microphone signal that directly approximates the perceived acoustic output of the headphone. The headphone generates such a microphone signal by including an array of at least two microphones within each headphone, which results in a microphone signal that is based on a spatial average of the two microphones. Further, the transducer includes a paper membrane which results in accurate pistonic motion throughout the audible band. These features allow for a simplified ANC control system. For example, since the microphone signal directly approximates the perceived acoustic output of the headphone, the ANC control system eliminates filters and their associated software/hardware, such as a secondary link filter for modeling or estimating the secondary path. Further, the ANC control system includes a controller that is configured to automatically calibrate the coefficients of an equalization filter corresponding to a specific user to provide a smooth response, by reducing or eliminating the remaining reflections in the ear cavity and cushion.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
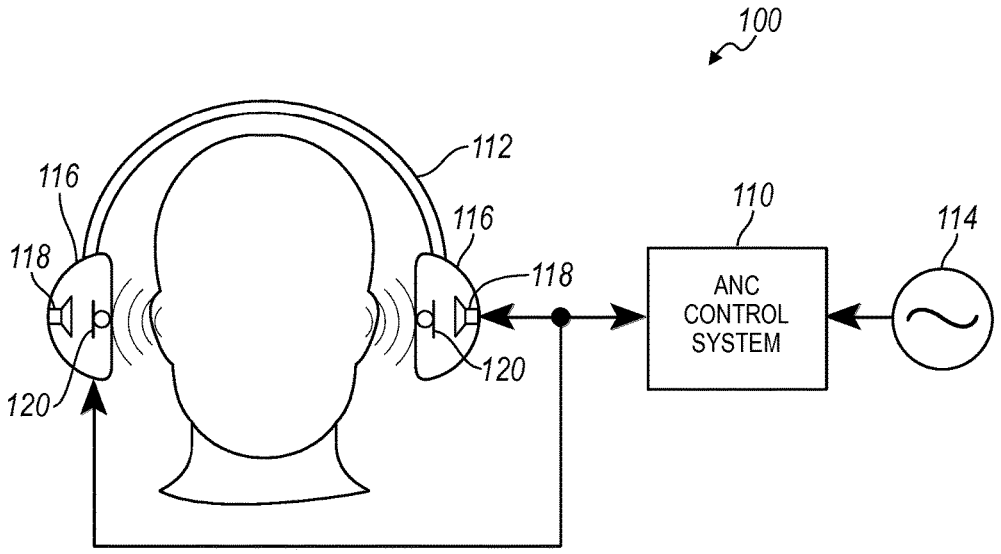
FIG. 1 is a schematic diagram illustrating a sound system including a noise cancelling control system connected to headphones and generating sound waves to a user, according to one or more embodiments.

With reference to FIG. 1, a sound system is illustrated in accordance with one or more embodiments and generally referenced by numeral 100. The sound system 100 includes an active noise cancelling (ANC) control system 110 and a headphone assembly 112. The control system 110 receives an audio input signal from an audio source 114 and provides an audio output signal to the headphone assembly 112. The headphone assembly 112 includes a pair of headphones 116. Each headphone 116 includes a transducer 118, or driver, that is positioned in proximity to a user's ear. The transducer 118 receives the audio output signal and generates audible sound. Each headphone 116 also includes one or more microphones 120 that are positioned between the transducer 118 and the ear.

Figure 2:
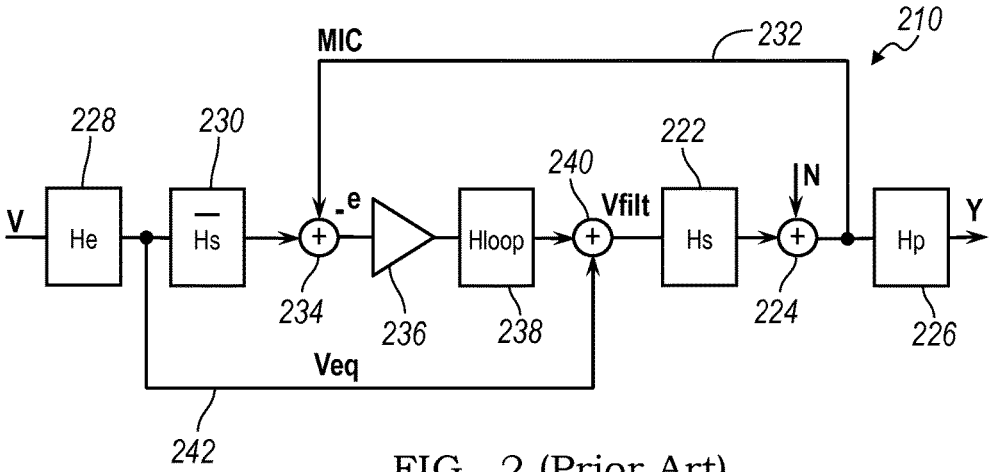
FIG. 2 (Prior Art)
FIG. 2 is a schematic block diagram of a prior art noise cancelling control system.

FIG. 2 is a schematic block diagram of a prior art ANC control system (first control system 210). The first control system 210 may be implemented in hardware and/or software control logic as described in greater detail herein. The first control system 210 receives an audio input signal (V) from an audio source (e.g., audio source 114) and provides a filtered audio signal ($V_{filt}$) to a transducer (e.g., the transducer 118) of each headphone, which is radiated from the transducer as sound. The sound is transferred from the transducer to a microphone within the headphone (e.g., microphone 120), along a secondary path or link, which is modeled by transfer function ($H_s$) 222. The microphone receives the sound radiated from the transducer and noise (N) within the headphone, which is represented by summation node 224, and generates a microphone output signal (MIC). The frequency response of the sound radiated from the transducer and N is modified by the shape of the user's ear cavity and the cushion between the headphone and the user's ear, which is modeled by a primary link filter ($H_p$) 226. The acoustic response of the headphone, as perceived by the user, is represented by audio output signal (Y).

The first control system 210 includes a pre-equalization filter ($H_e$) 228. The $H_e$ filter 228 filters the audio input signal (V) such that the acoustic output (Y) approximates a predetermined target function. The target function is determined empirically, or using subjective tests. The first control system 210 also includes a filter ($\overline{H}_s$) 230 that provides an estimate of the secondary link based on predetermined data. The $\overline{H}_s$ filter 230 estimates the transfer function of the sound radiated by the transducer due to the structure of the transducer, the cushion between the headphone and the user's head and the contour of the user's ear cavity.

The first control system 210 is an example of a feedback ANC control system. The microphone output signal (MIC) is present at a feedback path 232. At summation node 234, the first control system 210 generates an error signal (e) based on the difference between the output of the $\overline{H}_s$ filter 230 and the microphone output signal (MIC). The error signal (e) is provided to a gain 236 and to a loop filter ($H_{loop}$) 238. The $H_{loop}$ filter 238 adds additional gain to the error signal (e) at its peak center frequency, which is between 100-150 Hz, and is designed to maintain sufficient stability margins of the error signal (e).

The first control system 210 generates the filtered audio signal ($V_{filt}$) at summation node 240. The equalized audio input signal ($V_{eq}$) is provided to the summation node 240 along a side-chain, or feedforward path 242. The summation node 240 combines $V_{eq}$ with the filtered error signal to determine $V_{filt}$. As stated above, the summation node 224 adds the noise signal (N) to $V_{filt}$.

The transfer function for the first control system 210 may be expressed as follows:

$$Y = H_e H_p \left[ \frac{N}{1 + H_s H_{loop}} + V H_S \frac{1 + \overline{H}_s H_{loop}}{1 + H_s H_{loop}} \right]$$

Figure 3:
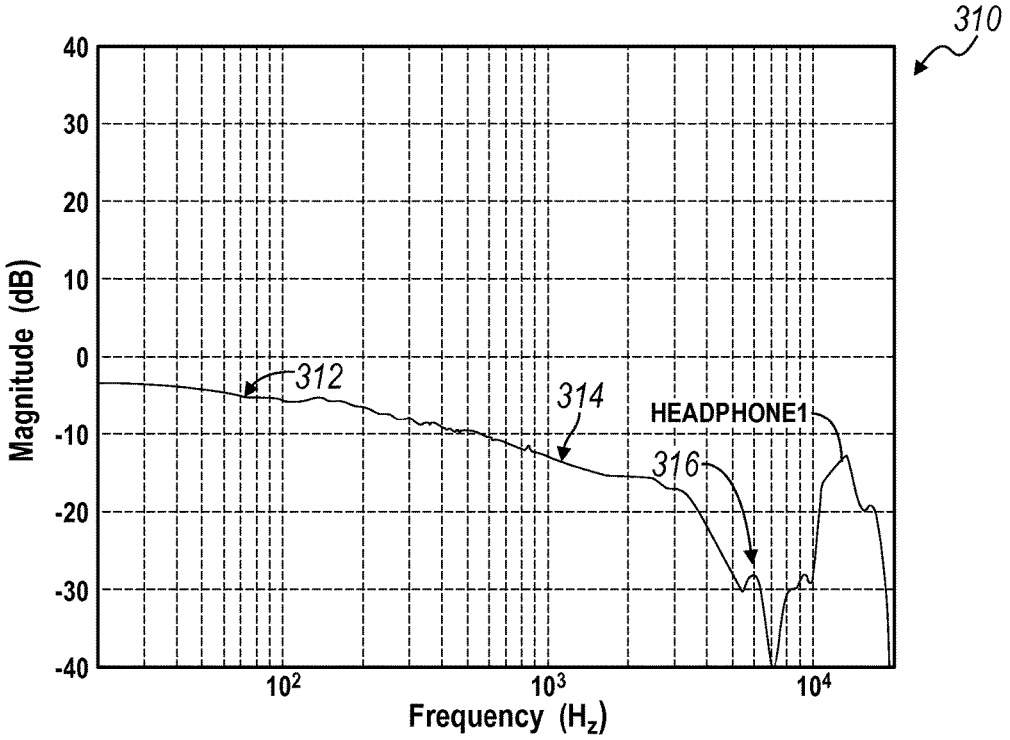
FIG. 3 (Prior Art)
FIG. 3 is a graph illustrating a frequency response of the acoustic path of the control system of FIG. 2.

FIG. 3 is a graph 310 that includes a curve, labeled "HEADPHONE1" that illustrates the frequency response of the acoustic path $H_s$. The HEADPHONE1 curve is relatively smooth at low frequencies, as referenced by numeral 312, and exhibits a strong low-pass characteristic. However, the HEADPHONE1 curve illustrates a downward slope at intermediate frequencies, as referenced by numeral 314 and a wide notch at high frequencies (above 3 kHz), as referenced by numeral 316. These characteristics of the acoustic path, as illustrated by the HEADPHONE1 curve, are a result of microphone placement, transducer quality, seal quality and ear cushion design.

Figure 4:
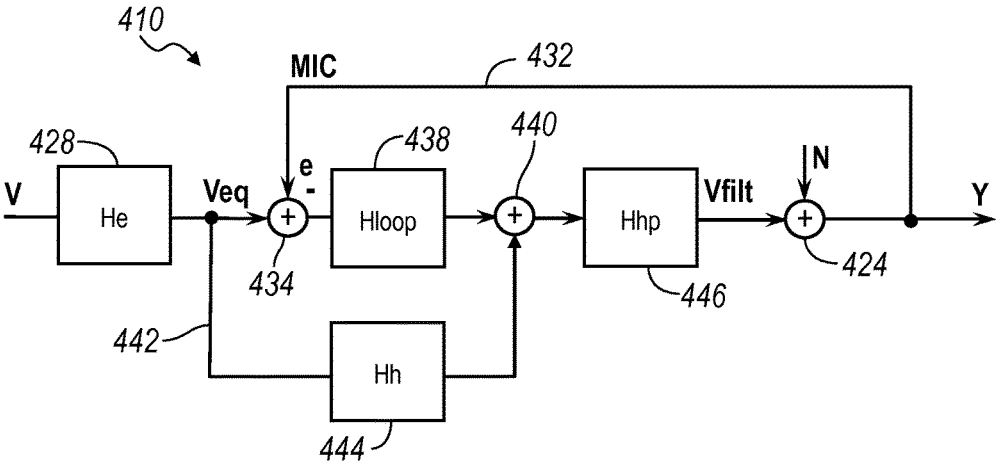
FIG. 4 is a schematic block diagram of the noise cancelling control system of FIG. 1, according to one or more embodiments.

With reference to FIG. 4, a schematic block diagram illustrating the operation of a second ANC control system is illustrated in accordance with one or more embodiments and is generally referenced by numeral 410. The sound system 100 (shown in FIG. 1) includes the second control system 410, according to one embodiment. The second control system 410 may be implemented in hardware and/or software control logic as described in greater detail herein. The second control system 410 receives an audio input signal (V) from the audio source 114 (shown in FIG. 1) and provides a filtered audio signal ($V_{filt}$) to a transducer 118 of a headphone 116, which is radiated from the transducer 118 as sound. The sound is transferred from the transducer 118 to the microphone 120, along a secondary path or link. The microphone 120 receives the sound radiated from the transducer 118 and noise (N) within the headphone 116, which is represented by summation node 424, and generates a microphone output signal (MIC). The acoustic response of the headphone 116, as perceived by the user, is represented by audio output signal (Y).

The second control system 410 includes a pre-equalization filter ($H_e$) 428. The He filter 428 filters the audio input (V) such that the acoustic output (Y) approximates a predetermined target function and generates an equalized audio signal ($V_{eq}$). The target function is determined using the method described in U.S. application Ser. No. 14/319,936 to Horbach, according to one or more embodiments. The $H_e$ filter 428 may be a cascade of multiple biquad equalization filters, or an FIR filter, according to one or more embodiments.

The second control system 410 is an example of a feedback ANC control system. The microphone output signal (MIC) is present at a feedback path 432. At summation node 434, the second control system 410 generates an error signal (e) based on the difference between the equalized audio input signal ($V_{eq}$) and the microphone output signal (MIC).

The second control system 410 is configured for a headphone that is acoustically designed such that the microphone output signal (MIC) approximates the perceived audio output (Y) of the transducer 118 directly. Since MIC approximates Y, the second control system 410 differs from the prior art first control system 210 (shown in FIG. 2) in that it does not include a filter for estimating the secondary link (e.g., $\overline{H}_s$ filter 230).

The second control system 410 is configured as a band-limited control loop where the low frequency portion of the audio input signal (V) is passed on a main path and the high frequency portion of the audio input signal (V) is added through a "side-chain" or feedforward path.

The main path of the second control system 410 includes a loop filter ($H_{loop}$) 438. The $H_{loop}$ filter 438 is configured such that the second control system 410 suppresses any deviation in the error signal, i.e., between the audio input signal (Y) and the microphone output (MIC), within a predetermined bandwidth. The $H_{loop}$ filter 438 also blocks high frequency signals.

The high frequency portion of the audio input signal (V) is added through a side-chain or feedforward path 442 that includes a high pass filter ($H_h$) 444. The $H_h$ filter 444 may be a first order filter, or a higher order filter, that is configured to pass signals having frequencies above 3-8 kHz, according to one or more embodiments. A summation node 440 combines the output of the $H_{loop}$ filter 438 with the output of the $H_h$ filter 444.

The transfer function ($H_{hp}$) for the second control system 410 is referenced by block 446, and may be expressed as follows:

$$Y = H_e\left[\frac{N}{1 + H_{hp}H_{loop}} + V(H_{low} + H_{high})\right], \quad \text{(equation 2)}$$

$$H_{low} = \frac{H_{hp}H_{loop}}{1 + H_{hp}H_{loop}} \approx 1,\ f < 1\ \text{kHz}, \quad \text{(equation 3)}$$

$$H_{high} = \frac{H_{hp}H_h}{1 + H_{hp}H_{loop}} \approx H_{hp},\ f > 1\ \text{kHz}. \quad \text{(equation 4)}$$

Figure 6:
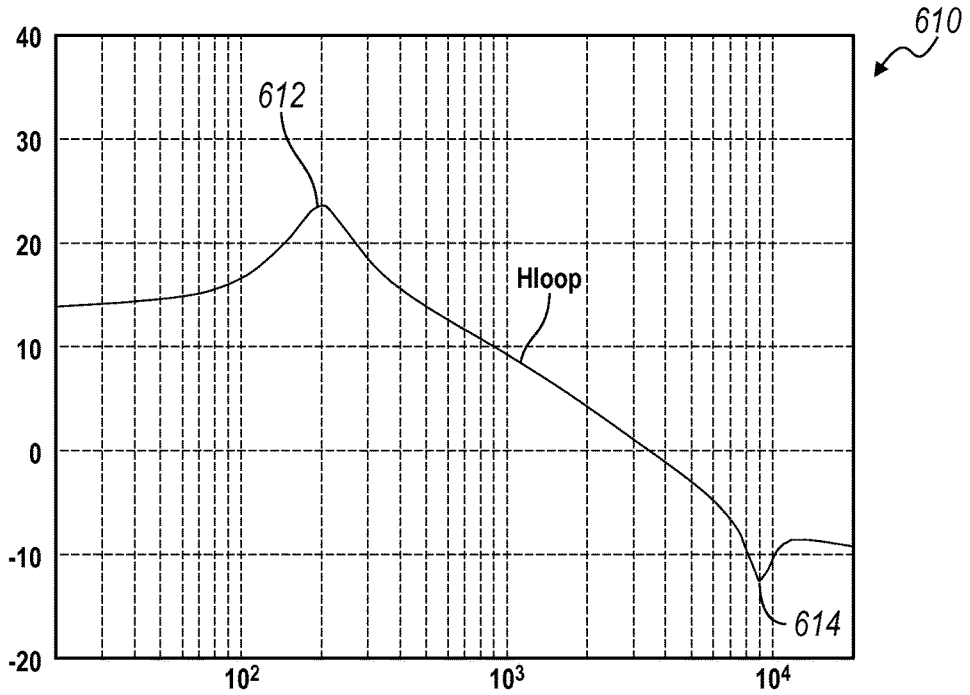
FIG. 6 is a graph illustrating an open loop frequency response of the loop filter of the control system of FIG. 4.
Figure 10:
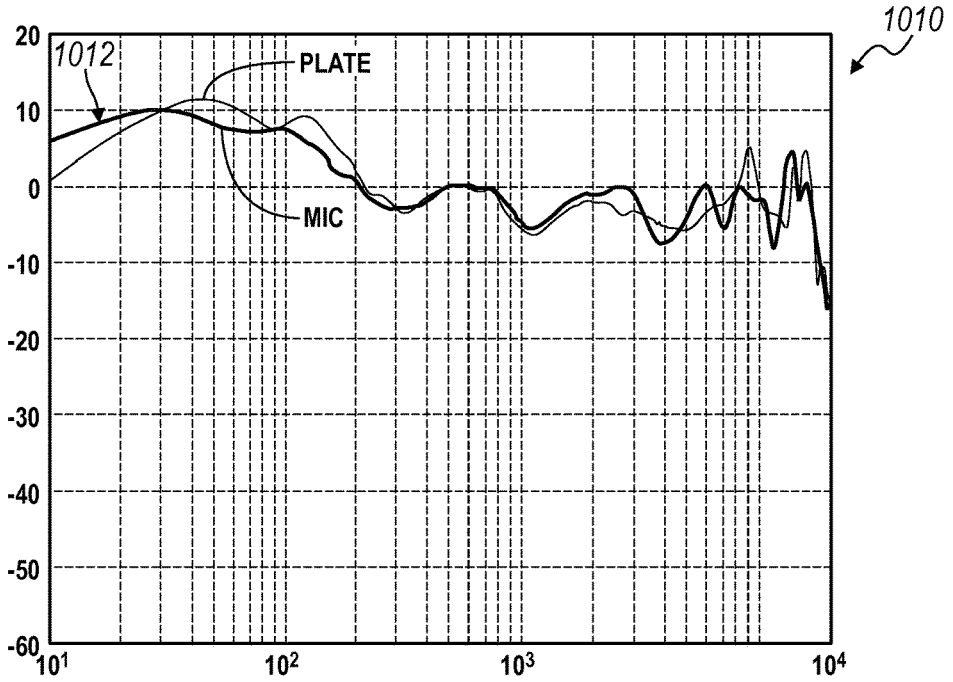
FIG. 10 is a graph illustrating a frequency response of the control system of FIG. 4 as measured using a test apparatus, and a frequency response of the control system of FIG. 4 as measured by an internal microphone.

Equations 2-4, which may be derived from the block diagram illustrated in FIG. 4, show that the signal transfer function (H=Y/V) is split into two parts $H_{low}$ and $H_{high}$. $H_{low}$ is approximately equal to 1 at frequencies below 1 kHz due to the high gain of $H_{loop}$*$H_{hp}$ in this frequency band (as shown in FIGS. 6 and 10), and thus tightly controlled by the feedback system (equation 3). The response (H) is generally independent of headphone seal or individual ear shape. At high frequencies, (e.g., f>1 kHz) the headphone response (H) is essentially unaltered (i.e., $H_{high}$=H) because the loop gain is small (equation 4).

The second control system 410 provides advantages over the prior art first control system 210 of FIG. 2 because the accuracy of the error signal (e) of the first control system 210 depends on the precision of the MIC signal estimate to a high degree. Therefore the estimation filter ($\overline{H}_s$) 230 is repeatedly calibrated, even during production. Additionally, the secondary link ($H_s$) 228 varies, depending on the amount of seal between the headphone 116 and the user's head, and the contour of the user's ear cavity. Therefore, the estimation filter ($\overline{H}_s$) 230 has low accuracy.

Additionally, the summation node 234, the gain stage 236 and the loop filter 238 of the first control system 210 are all separate stages, and are typically implemented using precise, low-noise and wide-band hardware components, which considerably adds to the cost of the first control system 210. However, as described below with reference to FIG. 5, similar portions of the second control system 410 may be implemented using fewer hardware components.

Figure 5:
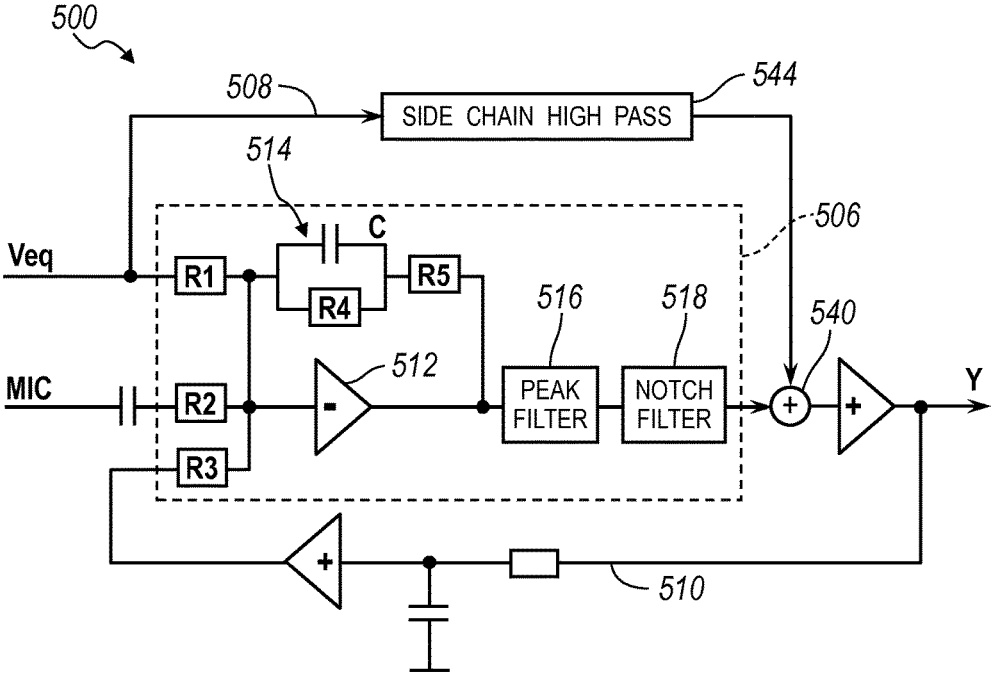
FIG. 5 is an apparatus implementing a portion of the control system of FIG. 4, according to one embodiment.

FIG. 5 is an apparatus 500 illustrating a hardware implementation of the second control system 410, according to one or more embodiments. The apparatus 500 includes a loop filter circuit 506, a side chain 508 and a DC-servo control path 510. The loop filter circuit 506 includes a leaky integrator circuit 514, a peak filter 516 and a notch filter 518. The summation node 434 and the $H_{loop}$ filter 438 of the second control system 410 are implemented by the leaky integrator circuit 514, the peak filter 516 and the notch filter 518. Generally, a leaky integrator circuit is designed to receive an input signal, integrate the signal and then gradually release or "leak" a small amount of the integrated signal over time.

The leaky integrator circuit 514 includes a plurality of resistors (R1, R2, and R3) for implementing the summation node 434 (shown in FIG. 4). R1 is connected to the $V_{eq}$ path, R2 is connected to the MIC path and R3 is connected to the DC-servo control path 510.

The loop filter circuit 506 includes the operational amplifier 512, the leaky integrator circuit 514, the peak filter 516 and the notch filter 518 for implementing the $H_{loop}$ filter 438 (shown in FIG. 4). The leaky integrator circuit 514 may be implemented as a feedback resistor-capacitor (RC) circuit, as shown in the illustrated embodiment. The peak filter 516 filters low frequency signals. In one embodiment the peak filter 516 is designed to amplify signals between 100-300 Hz. The notch filter 518 filters high frequency signals. In one embodiment the notch filter 518 is designed to attenuate signals between 6-10 kHz. Each filter 516, 518 is implemented as a single operational amplifier (op amp) in one embodiment. In other embodiments, the loop filter 438 may be implemented digitally, e.g., using a digital signal processor (DSP) with an infinite impulse response (IIR) filter (not shown).

The side chain 508 includes a high pass filter 544 for implementing the high pass filter ($H_h$) 444 (shown in FIG. 4). The high pass filter 544 may be a simple first order resistor-capacitor (RC) circuit, a high order filter, or a digital biquad filter.

The DC-servo control path 510 includes a buffered first order low pass filter to reduce the loop gain at DC to one, to ensure zero DC offset at the headphone transducer output. The entire path is DC-coupled, except the microphone, to ensure stability at low frequencies. The low pass filter may have a time constant of 1-3 seconds.

FIG. 6 is a graph 610 that includes a curve, labeled "$H_{loop}$" that illustrates the frequency response of the $H_{loop}$ filter 438, as implemented by the loop filter circuit 506. The peak filter 516 adds additional gain in the center of the noise canceling band (e.g., 200 Hz) to improve noise suppression, which is referenced by numeral 612. The notch filter 518 improves loop stability by suppressing high peaks of the transducer at a frequency range of approximately 6-10 kHz, which is referenced by numeral 614. Such high peaks of the transducer are generally a result of membrane breakup, which may result in a total loop gain of greater than one and thus cause instability.

Figure 7:
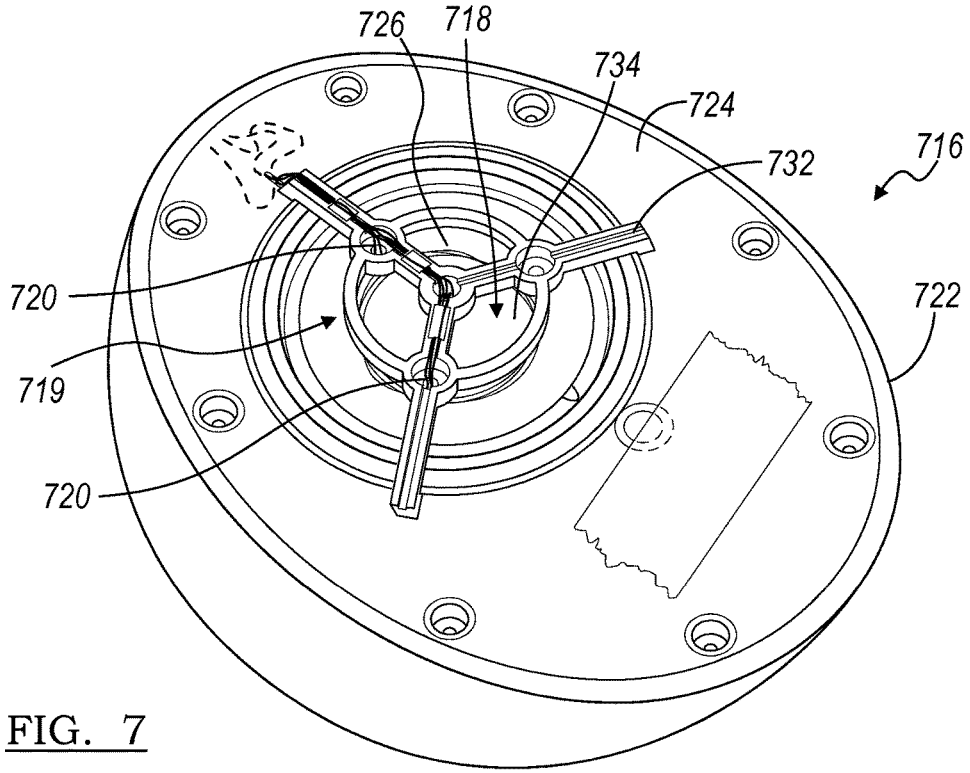
FIG. 7 is a side view of an inner portion of one of the headphones of FIG. 1, illustrated without an earpad.

With reference to FIG. 7, a circumaural headphone is illustrated in accordance with one or more embodiments and is generally referenced by numeral 716. The sound system 100 (shown in FIG. 1) includes a headphone assembly including a pair of the headphones 716, according to one or more embodiments. The headphone 716 is illustrated without an earpad. The headphone 716 includes features to decrease noise and distortion within the headphone, which results in the microphone output signal (MIC) approximating the perceived audio output (Y), as described above with reference to the second control system 410. The headphone 716 includes a transducer 718 and a microphone array 719 that includes two microphones 720.

The headphone 716 includes a housing 722 that is formed in a cup shape, according to the illustrated embodiment. The housing 722 includes an inner surface 724 with an aperture 726 formed into a central portion of the inner surface 724. The transducer 718 is disposed within the aperture 726 and supported by the housing 722. The transducer 718 is adapted to radiate sound away from the headphone 716.

The microphones 720 are mounted to a fixture 732 that extends from the inner surface 724 and across the aperture 726. The fixture 732 is designed to be acoustically transparent, so as not to distort the sound radiated by the transducer 718. The microphones 720 are mounted longitudinally adjacent to the transducer 718 and spaced apart from an outer surface of the transducer 718. The microphones 720 are oriented toward the outer surface of the transducer 718 and angularly spaced apart from each other about a central portion of the aperture 726 in a radial array. Additionally, the microphones 720 are electrically connected in parallel, which provides spatial averaging and thereby a more accurate representation of the perceived frequency response.

The transducer 718 is adapted to provide accurate pistonic motion throughout the audible band. The transducer 718 includes a small surround and a membrane cone 734 with center dome, formed of rigid materials such as fiber-reinforced paper, carbon, bio-cellulose, or anodized aluminum or titanium, or beryllium.

Figure 8:
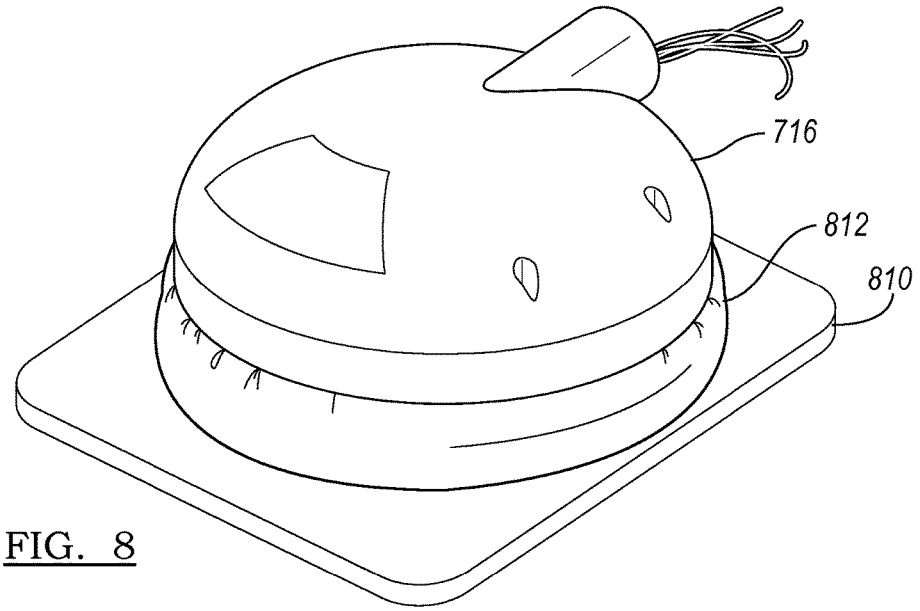
FIG. 8 is a side perspective view of the headphone assembly of FIG. 7, illustrated with an earpad and mounted to a test plate.

Referring to FIG. 8, a measurement plate 810 that includes flush mounted microphones, (not shown) is used to measure the perceived audio output of the headphone 716. An example of a test apparatus that includes such a measurement plate is described in U.S. application Ser. No. 14/319,936 to Horbach.

The headphone 716 includes an earpad 812 that is secured to a periphery of the inner surface 724 (shown in FIG. 7) and adapted to engage a user's head around the ear (not shown).

Figure 9:
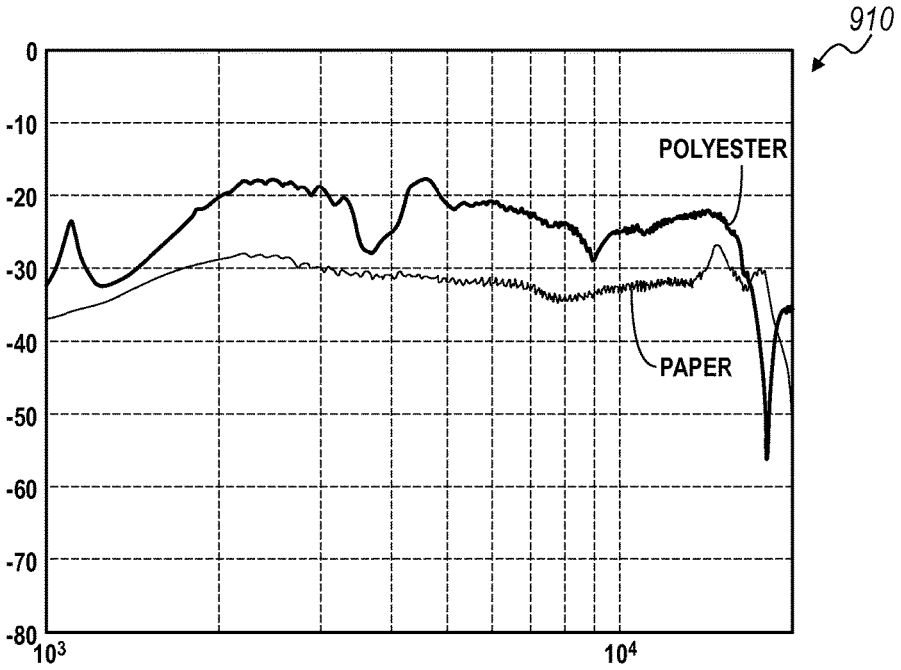
FIG. 9 is a graph illustrating the frequency response of a first transducer and the frequency response of a second transducer.

FIG. 9 is a graph 910 illustrating the frequency response of the headphone 716 equipped with different transducers, which are measured using the test plate 810. A first curve, labeled "POLYESTER", illustrates the frequency response of the headphone 716 with a transducer having a conventional membrane (not shown) formed of a polyester film, such as Mylar®, from Dupont. A second curve, labeled "PAPER", illustrates the frequency response of the headphone 716 with the transducer 718 having a membrane 734 that is formed of paper (shown in FIG. 7). The transducer 718 with the paper membrane 734 and small surround exhibits a smooth frequency response, as shown by the PAPER curve, in comparison to a conventional driver with a polyester membrane and large bending-type surround, as shown by the POLYESTER curve.

FIG. 10 is a graph 1010 illustrating the frequency response of the headphone 716, including the second control system 410 of FIG. 4, but without $H_e$, as measured by different microphones. A first curve, labeled "PLATE" illustrates the frequency response of the headphone 716 as measured by the test plate 810. A second curve, labeled "MIC", illustrates the frequency response of the headphone 716 as measured by the built-in microphone array 719. As shown in FIG. 10, both curves are very similar, except for some small deviations above 2 kHz.

Figure 11:
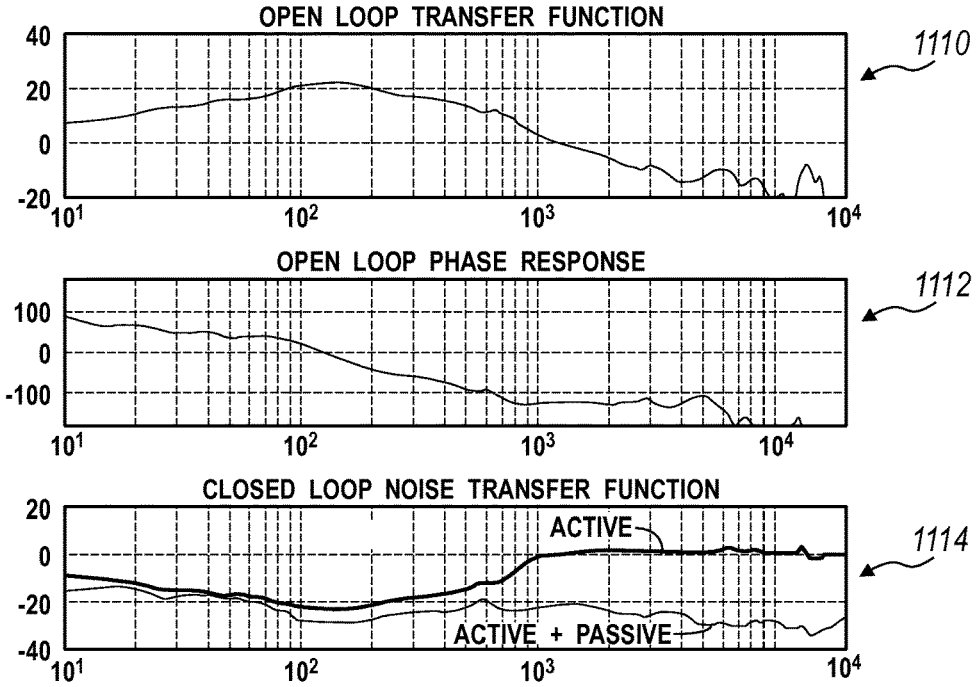
FIG. 11 is a bode plot illustrating an open loop frequency response and a closed loop frequency response of the control system of FIG. 4.

FIG. 11 includes graphs that illustrate the performance of the second control system 410 as implemented by the loop filter circuit 506, and measured by the test plate 810. A first graph 1110 is a Bode plot that illustrates the open loop transfer function of the second control system 410. A second graph 1112 illustrates the open loop phase response of the second control system 410. Referring back to FIG. 5, the open loop measurement is made between the loop filter circuit 506 and summation node 540, in one embodiment. A third graph 1114 is another plot illustrating the resulting closed loop noise transfer function of the second control system 410. The third graph 1114 includes a first curve, labeled "ACTIVE", that illustrates the noise transfer function, and a second curve, labeled "PASSIVE+ACTIVE", that illustrates the noise transfer function of the headphone 716, including the passive attenuation by the ear cushion 812.

The third graph 1114 illustrates that the second control system 410 provides a combined (active and passive) noise reduction of more than 20 dB across the entire audio band, and smooth responses with little overshoot. The second graph 1112 illustrates that the second control system 410 provides a sufficient phase margin throughout the frequency range.

Figure 12:
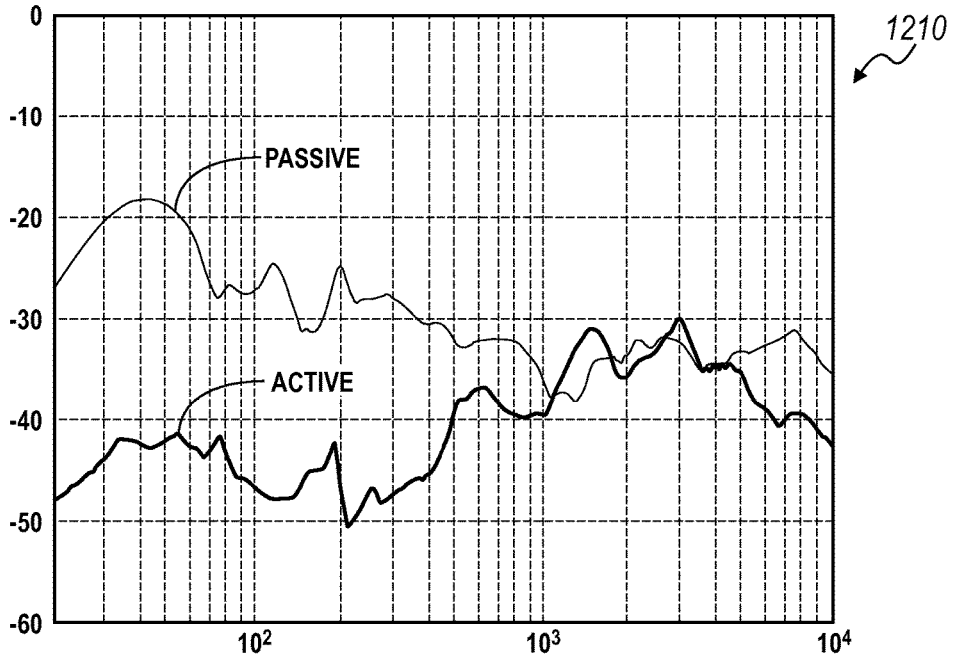
FIG. 12 is a graph illustrating a frequency response of the closed-loop distortion of the acoustic output of the control system of FIG. 4, compared with the open-loop distortion of the transducer.

FIG. 12 is a graph 1210 illustrating the frequency response of the closed-loop distortion, measured at its acoustic output, of the second control system 410, compared with the open-loop distortion of the transducer. A first curve, labeled "PASSIVE" illustrates the frequency response of the total harmonic distortion of the headphone 716 without ANC, as measured by the test plate 810. A second curve, labeled "ACTIVE", illustrates the frequency response of the total harmonic distortion of the headphone 716 with ANC active, as measured by the test plate 810. The ACTIVE curve illustrates the distortion reduction feature of the second control system 410, which is about 20 dB at low frequencies.

Figure 13:
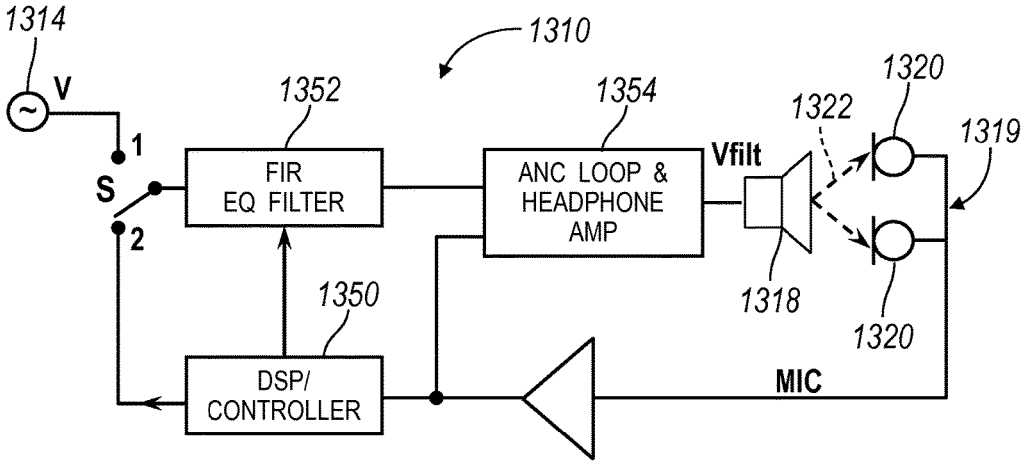
FIG. 13 is a schematic block diagram of the noise cancelling control system of FIG. 1, according to yet another embodiment.
Figure 14:
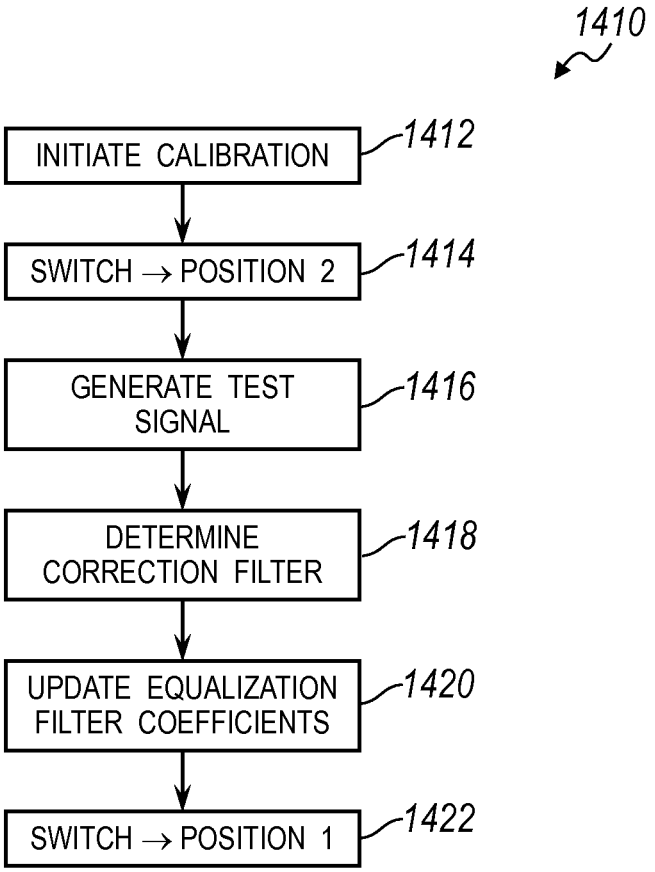
FIG. 14 is a flow chart illustrating a method for automatically calibrating a sound system that includes the noise cancelling control system of FIG. 13, according to one or more embodiments.

Referring to FIG. 13, a sound system is illustrated in accordance with one or more embodiments and generally referenced by numeral 1300. The sound system 1300 includes an active noise cancelling (ANC) control system 1310 and a pair of headphones (not shown) and an audio source 1314. Each headphone includes a transducer 1318 and a microphone array 1319 including at least two microphones 1320. The third control system 1310 receives an audio input signal (V) from the audio source 1314 and provides a filtered audio signal ($V_{filt}$) to the transducer 1318. The sound is transferred from the transducer 1318 to each microphone 1320 along a secondary path 1322. Each microphone 1320 receives the sound radiated from the transducer 1318 and noise (e.g., ambient sound and distortion, and provides a corresponding microphone output signal (MIC).

The third control system 1310 includes a controller 1350 in addition to the structure of the second control system 410 (shown in FIG. 4). The structure of the second control system is simplified and represented by an equalization filter (EQ) 1352 and an ANC loop and headphone amplifier block 1354. The third control system 1310 also includes a switch (S) that includes a first position (1) and a second position (2) for switching between two different audio sources. The switch connects the audio source 1314 to the EQ filter 1352 when it is oriented in the first position (1) and connects the DSP 1350 to the EQ filter 1352 when it is oriented in the second position (2).

The third control system 1310 is configured to automatically calibrate and customize the response for the user. The headphone frequency response is controlled by feedback only at low frequencies. However, it is possible to measure and correct the response at high frequencies using the EQ filter 1352. The EQ filter 1352 filters the audio input (V) such that the acoustic output approximates a predetermined target function. The target function is determined using the method described in U.S. application Ser. No. 14/319,936 to Horbach, according to one or more embodiments. The third control system 1310 is configured to adjust the coefficients of the EQ filter 1352 corresponding to the shape of the user's ear cavity and the cushion, to customize the response for the user, by reducing or eliminating reflections in the ear cavity and cushion.

A method for automatically calibrating a sound system that includes an ANC control system is illustrated in accordance with one or more embodiments and is generally referenced by numeral 1410. The method is implemented using software code contained within the DSP 1350, according to one or more embodiments.

At operation 1412, a calibration procedure is initiated while the user is wearing the headphones. The calibration procedure is initiated by the user, e.g., by the user pressing a button on the headphone assembly, according to one embodiment. In other embodiments, the calibration procedure may be initiated in response to a voice command, or by signaling through a USB port using a computer or a smartphone.

At operation 1414, the DSP 1350 controls the switch (S) to switch to the second position (2), and thereby connect the DSP 1350 to the input of the EQ filter 1352. At operation 1416, the DSP 1350 generates a test signal that is provided to the EQ filter 1352 and radiates as sound from the transducer 1318. In one embodiment the test signal is a short logarithmic sweep between 250 to 500 msec. The microphones 1320 of the microphone array 1319 measure the sound, along with any reflections or noise, and provide the microphone output signal (MIC) to the DSP 1350.

At operation 1418, the DSP 1350 computes a correction filter based on the captured sweep response through the noise canceling microphone array 1319. Next, at operation 1420, the DSP 1350 updates the coefficients of the EQ filter 1352. At operation 1422, the third control system 1310 turns the switch back to position 1, and the sound system 1310 resumes normal operation. In one or more embodiments, the DSP 1350 is configured to save the coefficients of the EQ filter 1352 in its memory, so that the user does not need to recalibrate the audio system 1300 before each use.

Figure 15:
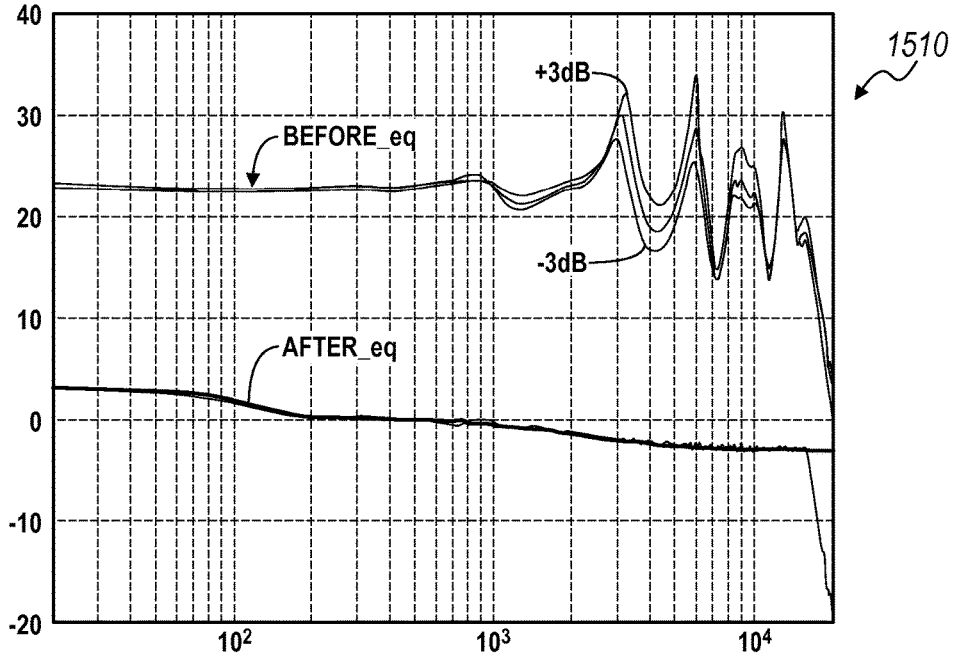
FIG. 15 is a graph illustrating a frequency response of the control system of FIG. 13.
Figure 16:
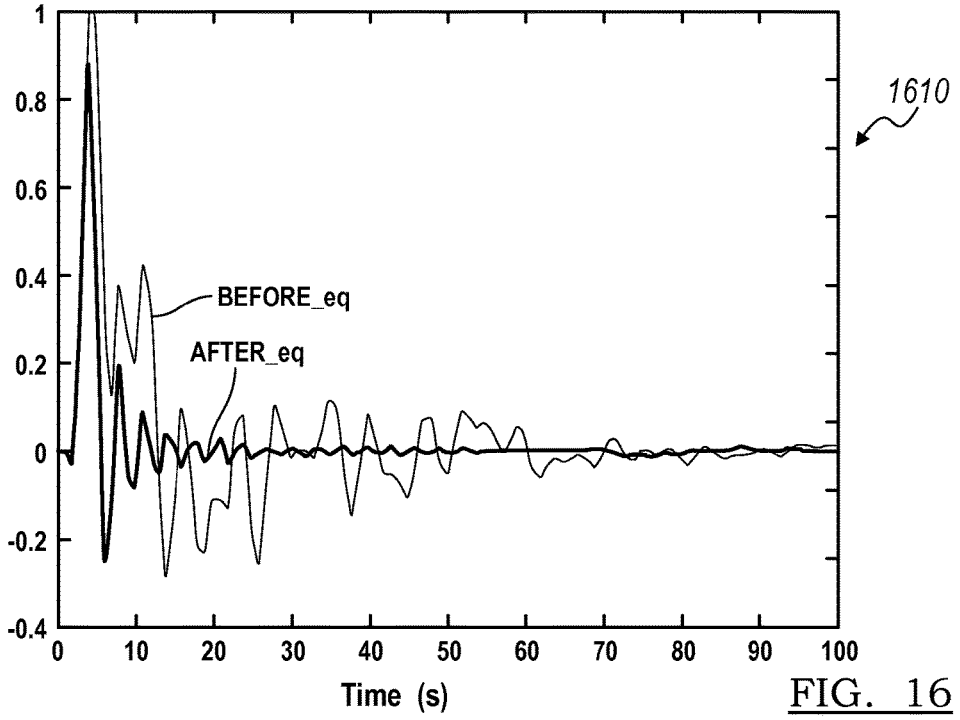
FIG. 16 is a graph illustrating the impulse response of the control system of FIG. 13.

FIG. 15 is a graph 1510 illustrating the frequency response of the third control system 1310. FIG. 16 is a graph 1610 illustrating the impulse response of the third control system 1310. Each graph 1510, 1610 includes at least one curve, labeled "BEFOREeq", that illustrates the frequency response of the third control system 1310 before equalization. Each graph 1510, 1610 also includes a second curve labeled "AFTEReq", that illustrates the frequency response of the third control system 1310 after equalization.

A comparison of the curves illustrates that the remaining reflections in the ear cavity and cushion, as seen by the transducer, can be eliminated through equalization, leading to a smooth response. This includes elimination of errors due to tolerances of the electromechanical components, in particular loop gain deviations. The target response has been chosen to mimic a typical in-room response when listening to loudspeakers, featuring a slight roll off towards high frequencies. In one embodiment, the equalization filter (EQ) 1352 is a minimum-phase FIR (finite impulse response) filter having a length of 64. This results in a fast decaying, non-dispersive headphone impulse response without pre-ringing, as shown in FIG. 16.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A sound system comprising:

a headphone including a transducer and at least two microphones disposed over the transducer and adapted to receive sound radiated therefrom;

an equalization filter adapted to equalize an audio input signal based on at least one predetermined coefficient; and a loop filter circuit including a leaky integrator circuit adapted to generate a filtered audio signal based on the equalized audio input signal and a feedback signal indicative of sound received by the at least two microphones, and to provide the filtered audio signal to the transducer; and a switch adapted to switch between a first position, in which the equalization filter is connected to an audio source for receiving a first audio input signal, and a second position, in which the equalization filter is adapted to receive a second audio input signal;

a controller programmed to:

control the switch to be arranged in the second position in response to a user command;

generate the second audio input signal which is indicative of a test signal;

receive a second feedback signal indicative of a test sound received by the at least two microphones;

calibrate the headphone by updating the at least one predetermined coefficient of the equalization filter based on the second feedback signal; and control the switch to be arranged in the first position in response to the at least one predetermined coefficient being updated.

2. The sound system of claim 1 wherein the at least one predetermined coefficient is modeled after a predetermined target function corresponding to the headphone.

3. The sound system of claim 1 further comprising a DC-servo that is arranged in a feedback path to provide a zero DC offset.

4. The sound system of claim 1 wherein the leaky integrator circuit further comprises an operational amplifier and a feedback resistor-capacitor (RC) circuit that are arranged in parallel.

5. The sound system of claim 1 wherein the loop filter circuit further comprises a peak filter that is adapted to apply a gain at a center frequency of the filtered audio signal.

6. The sound system of claim 1 wherein the loop filter circuit further comprises a notch filter that is adapted to suppress high magnitude peaks at a high frequency range of the filtered audio signal.

7. The sound system of claim 1 further comprising a high pass filter that is arranged in a feedforward path.

8. The sound system of claim 1 wherein the at least two microphones further comprises two microphones, and wherein the feedback signal is indicative of a spatial average of the sound received by the two microphones.

9. The sound system of claim 1 wherein the transducer further comprises a membrane formed of paper.

10. A computer-program product embodied in a non-transitory computer readable medium that is programmed for automatically calibrating an active noise cancellation control system within a headphone, the computer-program product comprising instructions for:

generating a first audio input signal that is indicative of a test signal;

filtering the first audio input signal using an equalization filter and a loop filter;

providing the first filtered audio signal to a transducer of the headphone, wherein the transducer is adapted to radiate a test sound in response to the first filtered audio signal;

receiving a first feedback signal indicative of a spatial average of the test sound received by at least one microphone of the headphone;

updating a coefficient of the equalization filter based on the first feedback signal receiving a second audio input signal from an audio source;

equalizing the second audio input signal using the equalization filter;

generating a second filtered audio signal using the loop filter based on the equalized second audio input signal and a second feedback signal indicative of a spatial average of sound received by the at least one microphone;

providing the second filtered audio signal to the transducer;

controlling a switch to be arranged in a second position in which the equalization filter is connected to a controller for receiving the first audio input signal;

generating the first audio input signal in response to the switch being arranged in the second position;

updating the coefficient of the equalization filter based on the first feedback signal; and controlling the switch to be arranged in a first position in which the equalization filter is connected to an audio source for receiving the second audio input signal, in response to the coefficient being updated.

* * * * *